United States Patent [19]

Yu

[11] Patent Number: 4,768,209

[45] Date of Patent: Aug. 30, 1988

[54] MAGNETIC INDUCTION COUNTING DEVICE

[76] Inventor: Ching-Yu Yu, No. 74, Lane 10, Sec. 2, Chang-Pyng Rd., Taichung, Taiwan

[21] Appl. No.: 55,024

[22] Filed: May 28, 1987

[51] Int. Cl.[4] ..... G06M 11/00

[52] U.S. Cl. ..... 377/6; 377/15; 235/98 C

[58] Field of Search ..... 377/6; 235/98 A, 98 B, 235/98 R, 98 C

[56] References Cited

U.S. PATENT DOCUMENTS

| | | | |
|---|---|---|---|
| 3,327,942 | 6/1967 | Blume | 235/98 C |
| 4,122,331 | 10/1978 | Tsubota et al. | 377/6 |
| 4,484,066 | 11/1984 | De Blieux et al. | 377/6 |
| 4,528,679 | 7/1985 | Shahbaz et al. | 377/6 |

*Primary Examiner*—John S. Heyman

*Attorney, Agent, or Firm*—Nixon & Vanderhye

[57] ABSTRACT

A magnetic induction counting device includes: an inductive source having a permanent magnetic member disposed therein and a structure adapted to be worn on a worker's hand during material handling and counting operations; at least two sensing members made of Hall element for detecting the magnetic field of the inductive source and producing a voltage signal; a plurality of amplifiers respectively connected to the sensing members for receiving and amplifying the voltage signal of the sensing members; a sequential processor coupled with the amplifiers for outputting a pulse signal according to a sequential and unilateral condition of the voltage signal received from the amplifiers; and a counter functionally connected to the sequential processor for performing counting and displaying operations according to the pulse signal; thereby, during material handling and counting operations, automatic counting of the materials can be conveniently carried out in accordance with the movement of the worker's hand wearing the inductive source.

3 Claims, 2 Drawing Sheets

MAGNETIC INDUCTION COUNTING DEVICE

BACKGROUND OF THE INVENTION

This invention relates to a counting device, and more particularly to a magnetic induction counting device by which automatic counting operation can be performed according to the movement of a worker's hand during material handling operations.

It is known that in order to maintain proper inventory transfer transactions and adequate itemization records, most manufacturing plants must rely on the accuracy of their material management department. Efficient inventory control methods are especially required by companies engaged in the manufacture of shoes and electronic parts where material handling operations are constantly conducted, and where every record must show the exact quantity of materials in daily receipts and issuances so as to keep an accurate balance of materials and achieve an effective material management. However, oral counting is the usual procedure adopted by the material management personnel for handling inventory operations. This primitive method of counting is easily susceptible to an external interference, such interruption often resulting in either a complete disremember-ance or a faulty recollection of the number of items counted. Other scientific devices such as a photo-sensing device, have been may be developed to count the number of times the worker's hand passes through an electric eye. However, the electric eye of the photo-sensing device must always be aligned with the worker's hand; otherwise, erroneous counting will occur. Thus, the working area has to be confined in a particular spot wherein the worker's hand is supposed to be held in motion. Furthermore, the counting performed by the electric eye may be falsely activated by foreign objects, such the flying insects, causing inaccurate counting.

SUMMARY OF THE INVENTION

It is accordingly a primary object of this invention to provide a magnetic induction counting device by which accurate counting can be automatically effected by the motion of the worker's hand.

This and other objects of this invention are achieved by providing a magnetic-induction counting device, which includes: an inductive means having a permanent magnetic member disposed therein and a structure adapted to be worn on a worker's hand for being kept in motion with the hand movement; at least two sensing means formed with Hall element for detecting the magnetic field produced by the inductive means and producing a voltage signal to be amplified and transmitted therefrom; a sequential processing means functionally associated with the sensing means for receiving the voltage signal of the sensing members and outputting a pulse signal when the voltage signal is transmitted in unilateral direction from the sensing means; and a counting means electrically coupled with the sequential processing means for indicating the counted numbers; thereby, counting operations can be accurately performed according to the worker's hand motion with the inductive means during material handling operations.

Other advantages and characteristics of the invention will become clear from the detailed description of a preferred embodiment when read in conjunction with the accompanying drawings.

DETAILED DESCRIPTION OF THE PREFERRED EMBODIMENT

Figure 1:
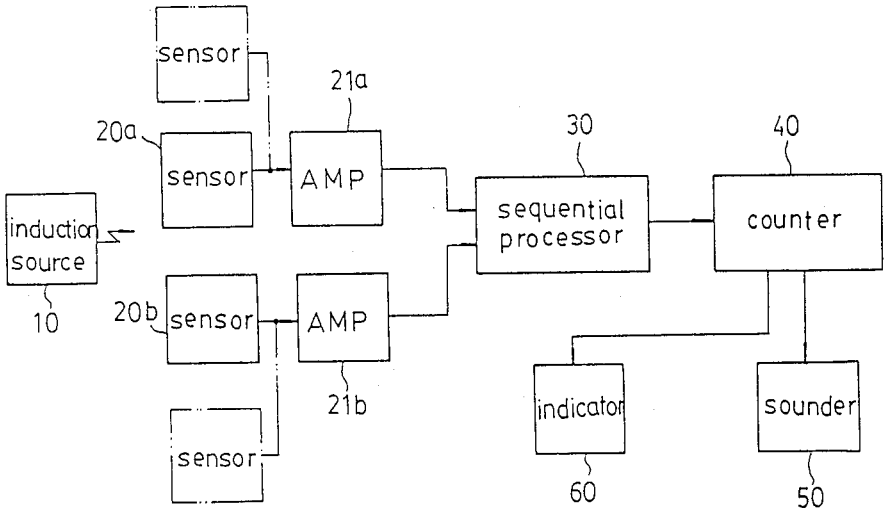
FIG. 1 is a block diagram of a preferred embodiment of a magnetic-induction counting device according to this invention.
Figure 3A:
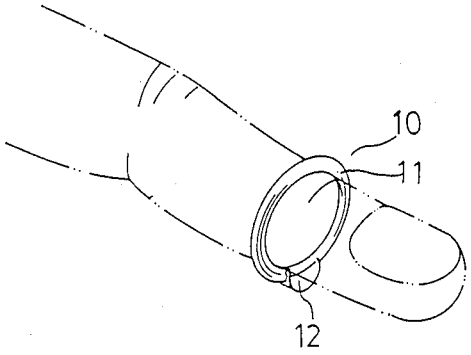
FIG. 3(A) is an illustrative view of an inductive means of the preferred embodiment for being worn on a worker's finger.
Figure 3B:
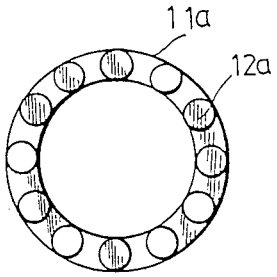
FIG. 3(B) is an illustrative view of another example of the inductive means of the preferred embodiment for being worn on a worker's arm.

Referring to FIGS. 1 and 3(A,B), the preferred embodiment of a magnetic induction counting device according to this invention includes: an inductive means 10 adapted to be worn on a worker's hand and formed either in a ring structure 11 with a permanent magnet 12 disposed in the ring 11, as shown in FIG. 3(A), or in a bracelet structure 12*a* with a plurality of permanent magnets 12*a* separately arranged therein, as shown in FIG. 3(B); at least two sensing means 20*a*, 20*b* formed with Hall elements for sensing the magnetic field of the inductive means 10 and producing a voltage signal therefrom; a plurality of amplifying means 21*a*, 21*b* respectively connected to the sensing means 20*a*, 20*b* for receiving and amplifying the voltage signal; a sequential processor 30 functionally coupled with the amplifying means 21*a*, 21*b* for receiving the amplified voltage signals and outputting pulse signals therefrom; a counting means 40 electrically connected to the sequential processor 30 for performing counting operations and displaying the counted numbers in accordance with the output of the sequential processor 30; a sound generating means 50 connected to the counting means 40 for producing a sound according to a basic counting number preset in the counting means 40; and a light indicating means 60 coupled with the counting means 40 for indicating the counted number according to preseet basic number. It shall be appreciated that since the Hall element of the sensing members 20*a*, 20*b* and the circuits of the amplifiers 21*a*, 21*b*, and the counter 40 are well known to those skilled in the art, details are omitted for brevity.

Figure 2:
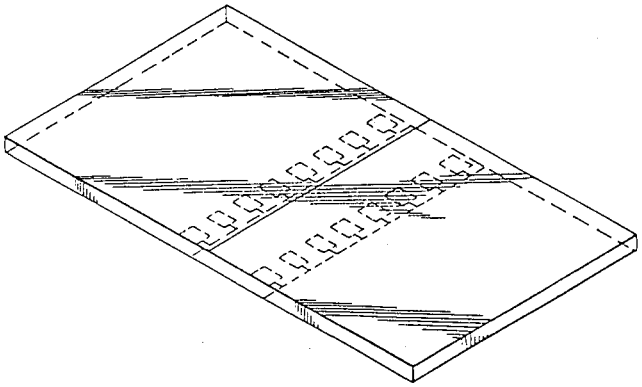
FIG. 2 is an illustrative view indicating an operational application of the preferred embodiment shown in FIG. 1.

Referring to FIG. 2, the sensing means 20*a*, 20*b* of the preferred embodiment according to this invention can be installed on the bottom surface of a working platform 70 and arranged in predetermined spaces, and, in order to identify the locations of the sensors 20*a*, 20*b*, a demarcation line 71 is provided between the locations of the sensors 20*a* and 20*b* on the top surface of the working platform 70. Thereby, in handling small-sized items such as electrical parts, the inductive ring 11 is put on a worker's finger with the permanent magnet 12 located under the finger, as shown in FIG. 3(A), and, by the movement of the worker's finger on the top surface of the working platform 70 during material handling, the changing magnetic field of the permanent magnet 12 from the inductive ring 11 will cause the related sensing means 20*a* or 20*b* to produce voltage signals and be fed into the related amplifying means 21*a* or 21*b* from which the amplified voltage signals will be transmitted to the sequential processor 30 for further processing operations. If the amplified voltage signals supplied to the sequential processor 30 are sequentially produced in a unilateral direction, the sequential processor 30 will output a pulse signal and feed it into the counting means 40 for effecting counting operations therein, and displaying the counted numbers therein. For ensuring accurate performance, the sequential processor 30 is adapted to output a pulse signal only when the permanent magnet 12 of the induction source 10 is completely moved out of the sensing range of the sensing means 20*a*, 20*b*.

On the other hand, if large-sized items of material are to be handled for which a worker must use both his hands to move the items or a single hand to perform loading and unloading operations without requiring the worker's fingers to be moved along the top surface of the platform 70, the inductive bracelet 11*a*, as shown in FIG. 3(B), is worn on the worker's arm so as to effectively increase the inductive range of the inductive ring 11*a*. Therefore, large-sized items are counted while using the inductive bracelet 11*a* and the sensing means 21*a*, 21*b*, the latter can effectively detect the magnetic field of the former and generate voltage signals to be fed into the sequential processor 30 through the amplifying means 21*a* and 21*b*.

It shall be appreciated that in order to widen the sensing range of the sensing means 20*a*, 20*b*, more sensing means similar to 20*a* and 20*b* can be parallel-coupled to form two sensing boundaries one in parallel to the other so as to be conveniently operated on the working platform 70. Moreover, the counting means 40 can be a multiplier type so as to enable the items to be counted in multiples so that the counting means 40 can automatically perform the counting by multiplying the counting times with the multiple number of the counted items for increasing the counting speed.

As show in FIG. 1, a sound generating means 50 is electrically connected to the counting means 40. By presetting a predetermined number in the counting means 40, when the counted number is met with the preset number in the counting means 40, a sound will be produced by the sound generating means 50 for reminding the user. In addition, a light indicating means 60 can also be connected to the counting means 40 for performing the same reminding function for the user as the sounding means 50.

Having thus described the invention, it is to be understood that many embodiments thereof will suggest themselves without departing from the spirit and scope of the invention. Therefore, it is intended that the specification and drawings be interpreted as illustrative rather than in a limiting sense except as defined in the appended claims.

What is claimed is:

1. A magnetic induction counting device comprising:

an inductive means having a permanent magnetic member disposed therein and formed in a structure adapted to be worn on a worker's hand during material handling and counting operations;

a plurality of sensing means made on the basis of Hall elements and adapted to be installed on a working structure for detecting a magnetic field condition of said inductive means according to a movement of the worker's hand during material handling and counting operations and outputting a voltage signal therefrom; a plurality of amplifying means respectively coupled with said sensing means for amplifying and outputting the voltage signal received from said sensing means;

a sequential processing means electrically connected to said amplifying means for receiving the amplified voltage and outputting a pulse signal under the condition that the amplified voltage signal is sequentially supplied in a unilateral direction from said sensing means; and a counting means electrically connected to said sequential processing means for performing counting operations according to the pulse signal received from said sequential processing means and displaying the counted numbers; whereby, during material handling and counting operations, automatic counting can be accurately performed in accordance with a movement of the worker's hand.

2. A magnetic induction counting device according to claim 1 further comprises a sound generating means functionally connected to said counting means for producing a sound in accordance with a basic counting number preset in said counting means so as to effect a sound reminding function according to the preset basic counting number during material handling and counting operations.

3. A magnetic induction counting device according to claim 1 further comprises a light indicating means functionally connected to said counting means for effecting a light reminding function during material handling and counting operations in accordance with the basic counting number preset in said counting means.

* * * * *